US006582246B1

(12) United States Patent
Rensi

(10) Patent No.: US 6,582,246 B1
(45) Date of Patent: Jun. 24, 2003

(54) FOLDABLE CONNECTOR ASSEMBLY FOR ELECTRONIC DEVICE

(76) Inventor: Edward G. Rensi, 2820 Blue Slopes Dr., Bloomington, IN (US) 47408

( * ) Notice: Subject to any disclaimer, the term of this patent is extended or adjusted under 35 U.S.C. 154(b) by 0 days.

(21) Appl. No.: 10/251,695

(22) Filed: Sep. 18, 2002

(51) Int. Cl.[7] ..... H01R 13/64
(52) U.S. Cl. ..... 439/377
(58) Field of Search ..... 439/377, 64

(56) References Cited

U.S. PATENT DOCUMENTS

| | | | | |
|---|---|---|---|---|
| 5,145,397 A | | 9/1992 | Yamada et al. | 439/328 |
| 5,889,656 A | | 3/1999 | Yin | 361/801 |
| 5,928,024 A | | 7/1999 | Ming-Huang | 439/377 |
| 5,980,299 A | | 11/1999 | Davis | 439/377 |
| 6,031,715 A | | 2/2000 | Magette | 361/683 |
| 6,038,131 A | | 3/2000 | Valosen et al. | 361/756 |
| 6,056,583 A | * | 5/2000 | Lee et al. | 439/377 |
| 6,089,899 A | | 7/2000 | Wang et al. | 439/377 |
| 6,089,900 A | | 7/2000 | Ma | 439/377 |
| 6,315,263 B1 | | 11/2001 | Wang | 248/694 |

* cited by examiner

*Primary Examiner*—Lynn Feild
*Assistant Examiner*—Phuong K Dinh
(74) *Attorney, Agent, or Firm*—Mark Homer

(57) ABSTRACT

A connector assembly with foldable card guides that, when folded, completely cover the array of electrical connectors resident on the connector housing. The connector assembly is shown in the context of a testing unit for automated test equipment. The folding feature is helpful when the connector assembly is not being used inasmuch as the card guides provide environmental protection (i.e. prevent the collection of dirt and/or particulate matter) for the electrical contacts resident in the connector housing. The foldable card guides incorporate spring-loaded bullet pins and radial locators at the points where they are pivotally attached to the connector housing, thereby allowing them to be locked in either an open or closed position. The foldable design saves space, affords protection, decreases the chance of inadvertent injury to personnel, and secures the testing unit for shipment. When the card guides are locked in the open position, they direct an electronic device subject to testing (e.g. an RF converter) into and out of the testing unit.

12 Claims, 6 Drawing Sheets

FOLDABLE CONNECTOR ASSEMBLY FOR ELECTRONIC DEVICE

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

The present invention relates to connector assemblies for electronic devices and, more particularly, to foldable connector assemblies used to establish and maintain reliable electrical and mechanical links between RF connections and testing equipment.

2. Description of the Background

There is a significant market for automated test equipment (ATE) instrumentation, software, and test systems for electronics, aerospace, semiconductors, communications, medical, industrial, and military applications. Automatic test equipment is now commonly used for final quality control, endurance testing, environmental testing, and for field tests on terminals, computers and other electronics. Known ATE devices range from the simple conductivity testers to sophisticated computerized test stations which test all forms of electronic response. The costs associated with automatic test equipment create a demand for multi-purpose test equipment, useable for a wide variety of units under test (UUTs). However, the test equipment often requires an adapter (or "testing unit") to interface with each UUT. These adapters are often suited for the temporary attachment of a wide variety of electronic devices, in each case making an electrical connection between the UUT and the automated test equipment. The actual electrical contact between the testing unit and the UUT is typically by way of a standard connector, such as a high density board-to-board connector wielding an array of delicate male and/or female pins. Unfortunately, the physical size and weight of the UUT is generally too great to be completely, and reliably, supported by the delicate connectors. A secondary, mechanical means of supporting the physical dimensions and weight of the UUT, without compromising the efficacy of the electrical connection between the testing unit and the UUT, is often required.

For the foregoing reason most commercially-available connector assemblies also incorporate a mechanical structure designed to facilitate and secure the electrical connection, despite the bulk of the parts. The prior art is populated by connector assemblies possessing a wide variety of shapes and sizes. An often utilized shape is that of an open-topped rectangle (e.g. ⊔), wherein the base surrounds and facilitates the electrical connection and the sides provide necessary physical/mechanical support. However, as the connection density of connectors increases, the support afforded by the mating pins decreases. Consequently, a variety of more elaborate connector assemblies have evolved with side arms, or device guides that support the UUT.

For example, where the UUT is a simple circuit card, the testing unit may be provided with flanking guide arms into which the circuit card slides for mating with the connector. Indeed, folding side arms are a known feature for conserving space, inasmuch as they can be folded down when not in use. An example of a connector assembly with folding guide arms is provided in FIGS. 1 and 2. FIG. 1 is a top perspective view of a prior art connector assembly 20 showing the device guides 25 in the open position, and FIG. 2 shows the guides 25 in the closed position. A plurality of channels 27 are present in each guide 25 to guide insertion and thereafter support the edges of any electronic circuit card placed therein. It is readily evident that, with the guides 25 folded inward as in FIG. 2, the overall volume occupied by the connector assembly 20 is significantly reduced.

Additional prior art may be found in U.S. Pat. No. 5,889,656 to Yin, U.S. Pat. No. 5,980,299 to Davis, U.S. Pat. No. 6,038,131 to Valosen et al., U.S. Pat. No. 6,056,538 to Lee et al., U.S. Pat. No. 6,089,899 to Wang et al., and U.S. Pat. No. 6,315,263 to Wang.

U.S. Pat. No. 5,889,656 to Yin discloses an add-on electronic module, with pivoting arms, for installation in a computer apparatus. The pivoting design provides three positions for the retaining arm with respect to the pivot base: a folded storage position, an open receiving position, and an unfolded retaining position. U.S. Pat. No. 5,980,299 to Davis discloses a module guide assembly for surrounding a receptacle connector on a circuit board with guide members to facilitate the mating of a circuit card with the connector. The guide members are pivotally mounted for rotation between an upright orientation for module receipt, and a recumbent orientation parallel to the board when the module is not mated to the connector. U.S. Pat. No. 6,038,131 to Valosen et al. discloses a mounting structure with retractable guides for mounting packaged processors on computer mother-boards. The invention allows a semi-finished circuit board to be prepared for further processing or transportation by retracting the guides to greatly reduce the height and volume of the board. U.S. Pat. No. 6,056,583 to Lee et al. discloses a foldable support bracket assembly for use with a connector comprising a support bracket with a mounting joint at each end thereof, and support pillars pivotally assembled to the mounting joints. U.S. Pat. No. 6,089,899 to Wang et al. discloses a module card retainer that includes a base closure having two elongated side walls and two pivotally connected clamping arms. U.S. Pat. No. 6,315,263 to Wang discloses a collapsible mount for mounting an electronic device to a circuit board. The apparatus includes a base adapted to be fixed to the circuit board and two support arms each having a lower end pivotally connected to the base and spaced from each other so as to be rotatable with respect to the base between a stowed position and an expanded position.

While each of these prior art examples attempts to conserve space, they fail to address two additional important issues. First, in order to function properly, the array of male and/or female pin-like connectors resident on the testing unit, to which the connector assembly is attached, must be maintained in a substantially dirt- or particulate-free condition. Dirt and/or other particulate matter, if present in one or more of the connectors, will tend to interfere with the electrical connection between the testing unit and the attached device and lead to incorrect test results. The prior art does not suggest any means to prevent the collection of dirt or particulate matter in, or on, the connector array. Second, the exposed array of male and/or female pin-like connectors resident on the testing unit may represent a hazard, electrical or otherwise, to persons in their vicinity. An inadvertent touching of one or more connectors might result in an unpleasant or dangerous electrical shock, or a small yet painful puncture wound.

It would, therefore, be greatly advantageous to provide a connector assembly that, in addition to possessing foldable device guides for space conservation, also provides the means to completely cover the array of male and/or female pin-like connectors resident on many electronic devices and/or testing equipment. An apparatus for this purpose should be durable due to the nature of its use, and economical to manufacture and sell to provide for widespread use.

SUMMARY OF THE INVENTION

It is, therefore, an object of the present invention to provide an improved connector assembly with foldable side arms/device guides that, when folded, completely cover the entire array of connector pins resident on the connector assembly.

It is another object to provide an improved connector assembly with foldable side arms/device guides that prevent the ingress of dirt and/or particulate matter to the array of connector pins resident on the connector assembly.

It is still another object to provide an improved connector assembly with foldable side arms/device guides that prevent harm to an individual due to the inadvertent touching of an exposed connector pin.

Yet another object of the present invention is to provide an improved connector assembly with foldable side arms/device guides that is durable to maximize longevity, and yet economical to manufacture.

According to the present invention, the above-described and other objects are accomplished by a connector assembly with foldable device guides that, when folded, completely cover the array of electrical connectors resident on the electronic device (e.g. testing unit) to which the connector assembly is attached. When the testing unit is not being used and the device guides are in the closed position, they provide environmental protection (i.e. prevent the collection of dirt and/or particulate matter) for the electrical connectors resident on the testing unit. The foldable device guides incorporate spring-loaded bullet pins and radial locators positioned at the points where they are pivotally attached to a connector housing to lock in either an open or closed position. The foldable design saves space, protects the electrical connectors, decreases the chance of inadvertent injury to personnel, and secures the device guides for shipment. When the device guides are locked in the open position, they direct an electronic device, subject to testing (e.g. RF converter), into and out of the testing unit interface. The connector assembly of the present invention is fabricated of a variety of strong, non-conductive materials to provide a high level of durability as required by the nature of its usage. The present invention's design is simple and straightforward, and can be economically manufactured.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

Figure 1:
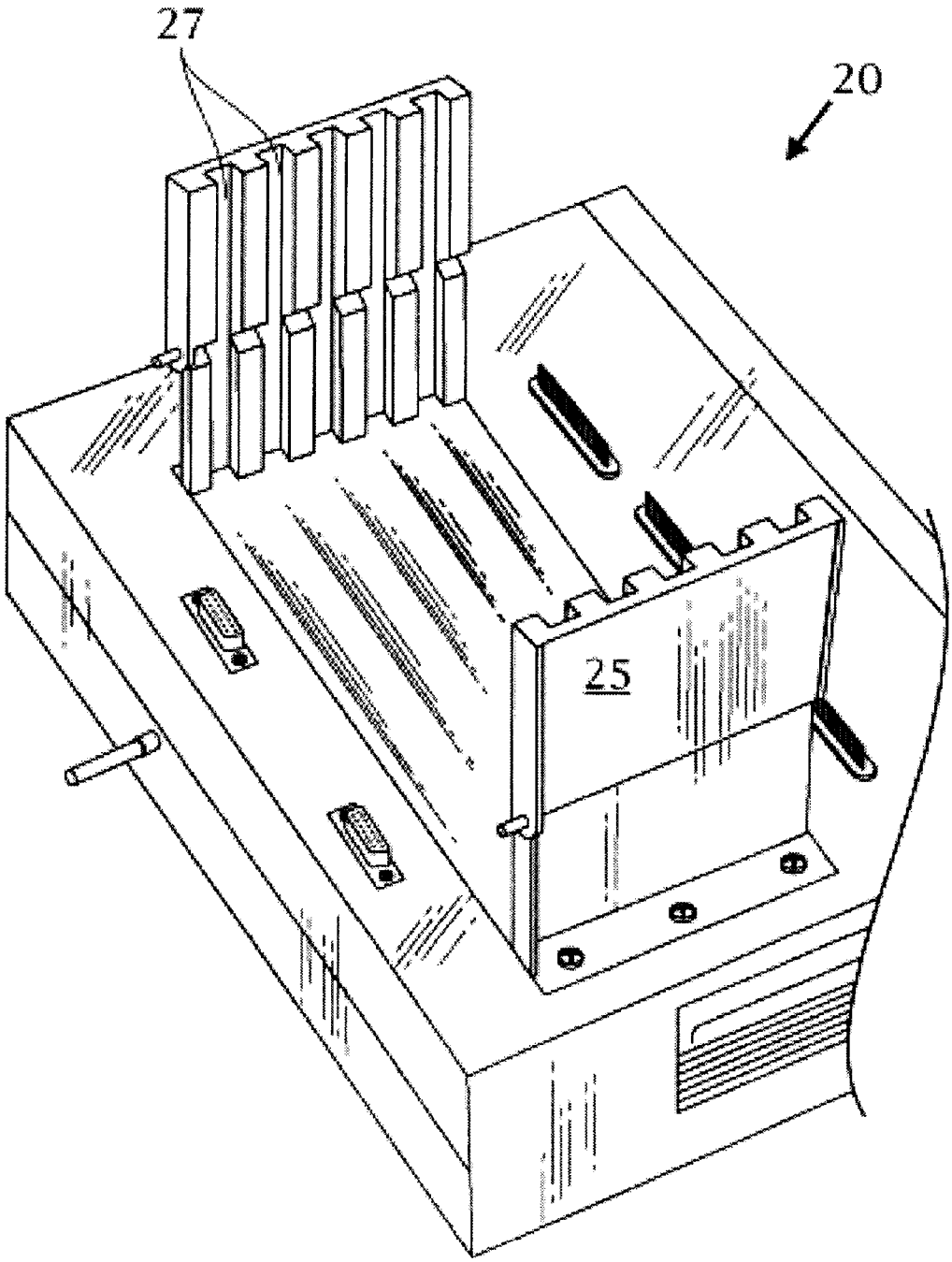
Fig. 1 (PRIOR ART)
FIG. 1 is a top perspective view of a prior art connector assembly 20 showing device guides 25 in an open position.
Figure 2:
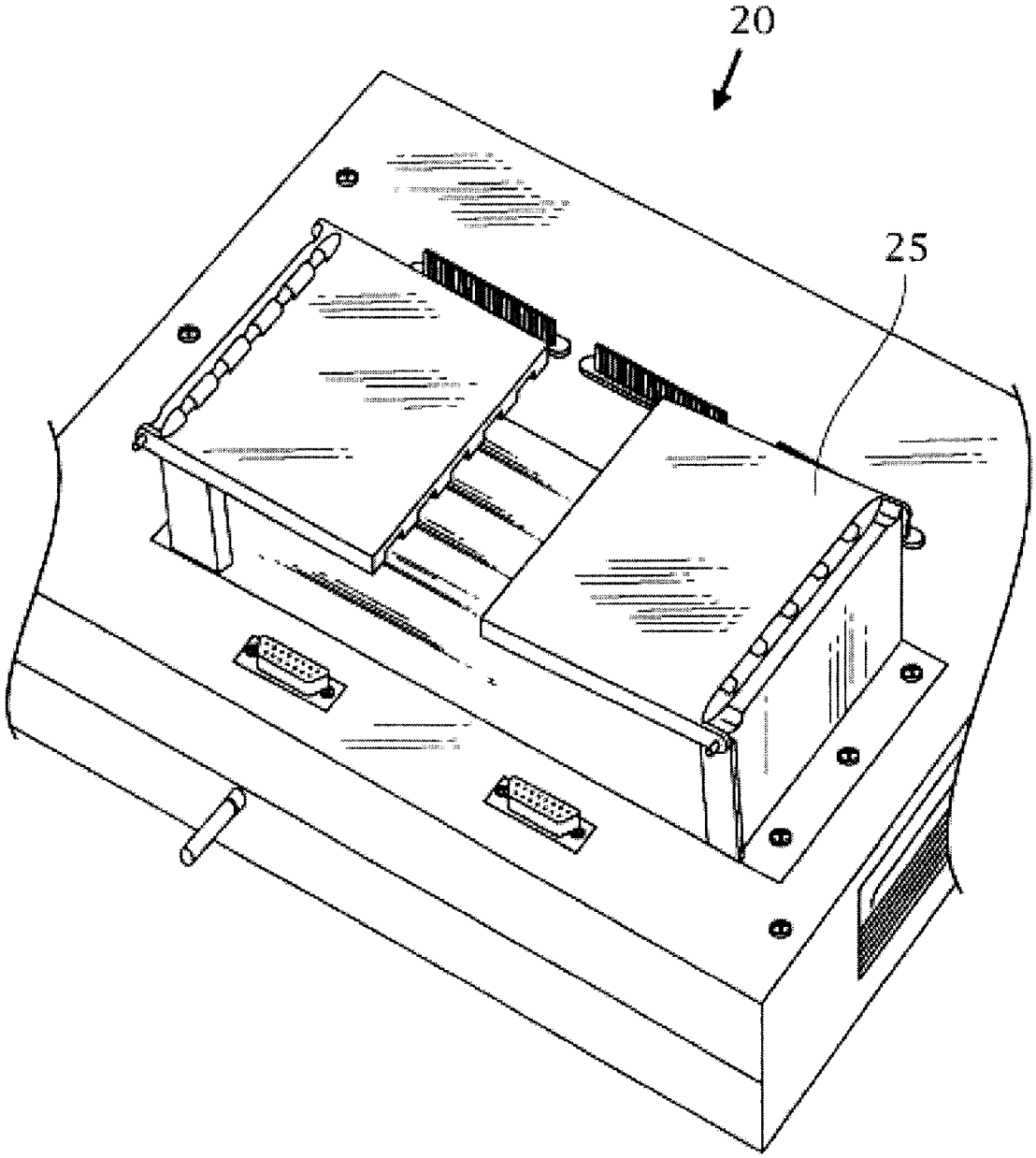
Fig. 2 (PRIOR ART)
FIG. 2 is a top perspective view of a prior art connector assembly 20 showing the device guides 25 in a closed position.
Figure 3:
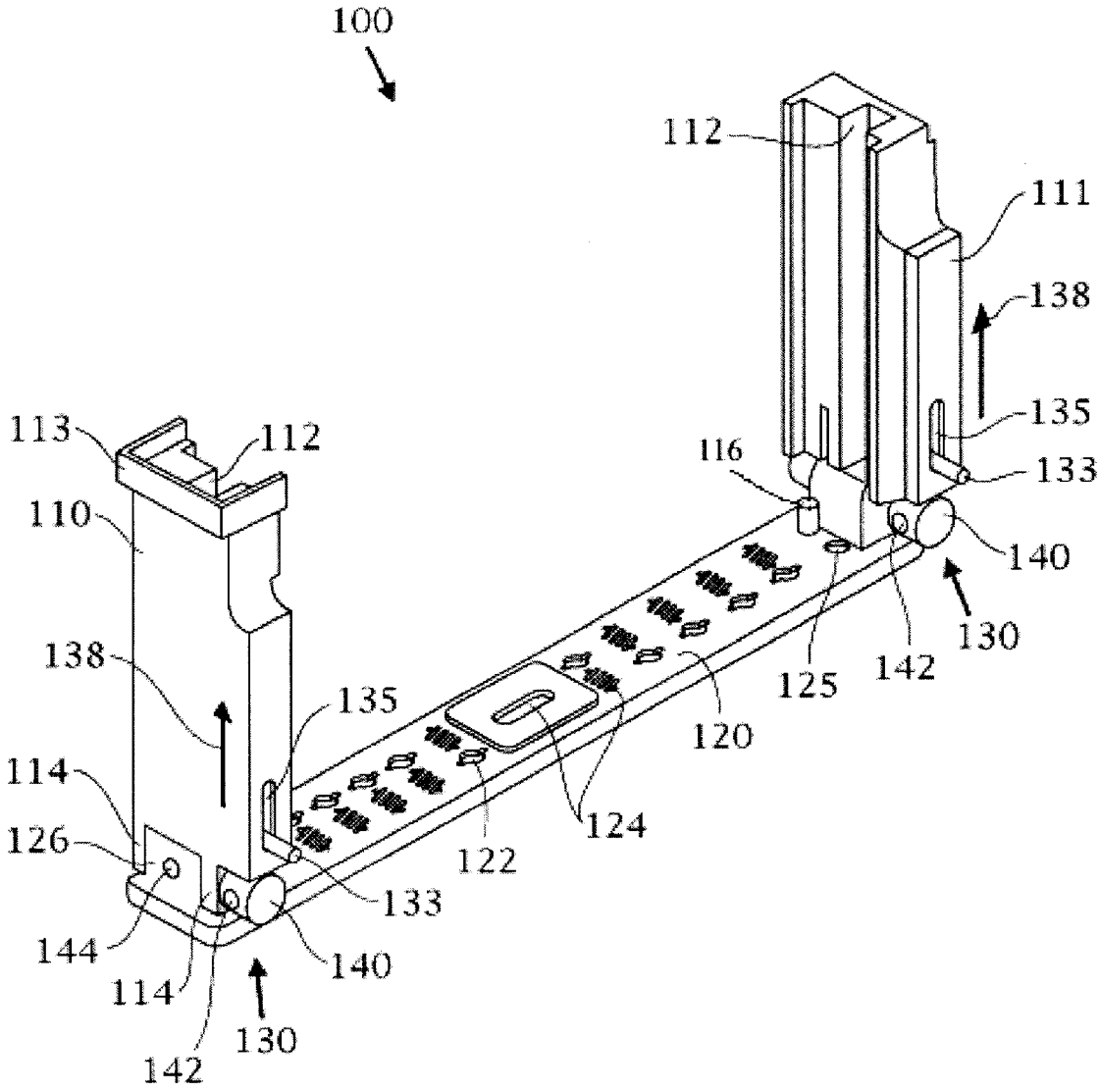
FIG. 3 is a top perspective view of a connector assembly 100 according to the present invention showing the device guides 110, 111 in an open position.
Figure 4:
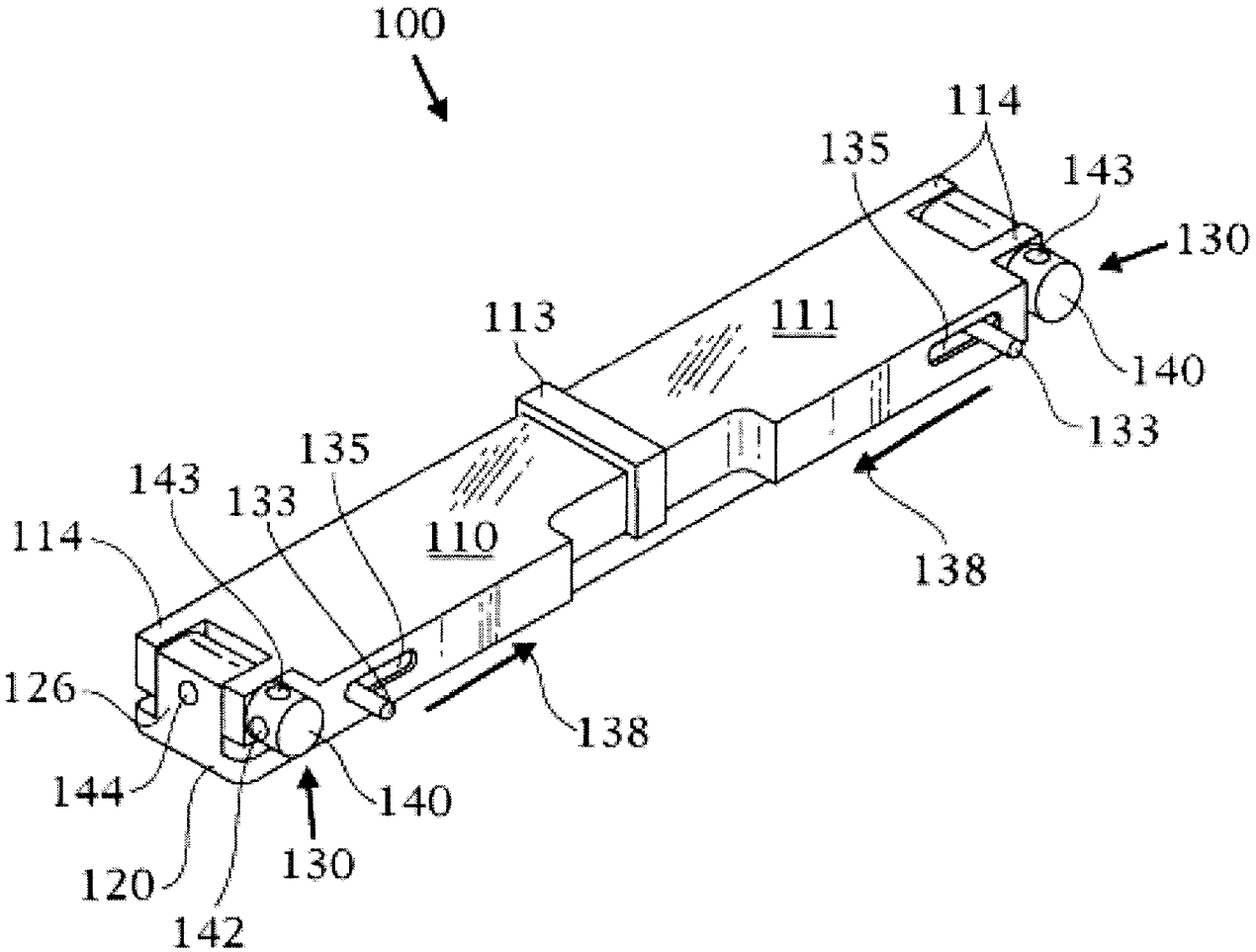
FIG. 4 a top perspective view of the connector assembly 100 of FIG. 3 showing the device guides 110, 111 in a closed position.
Figure 5:
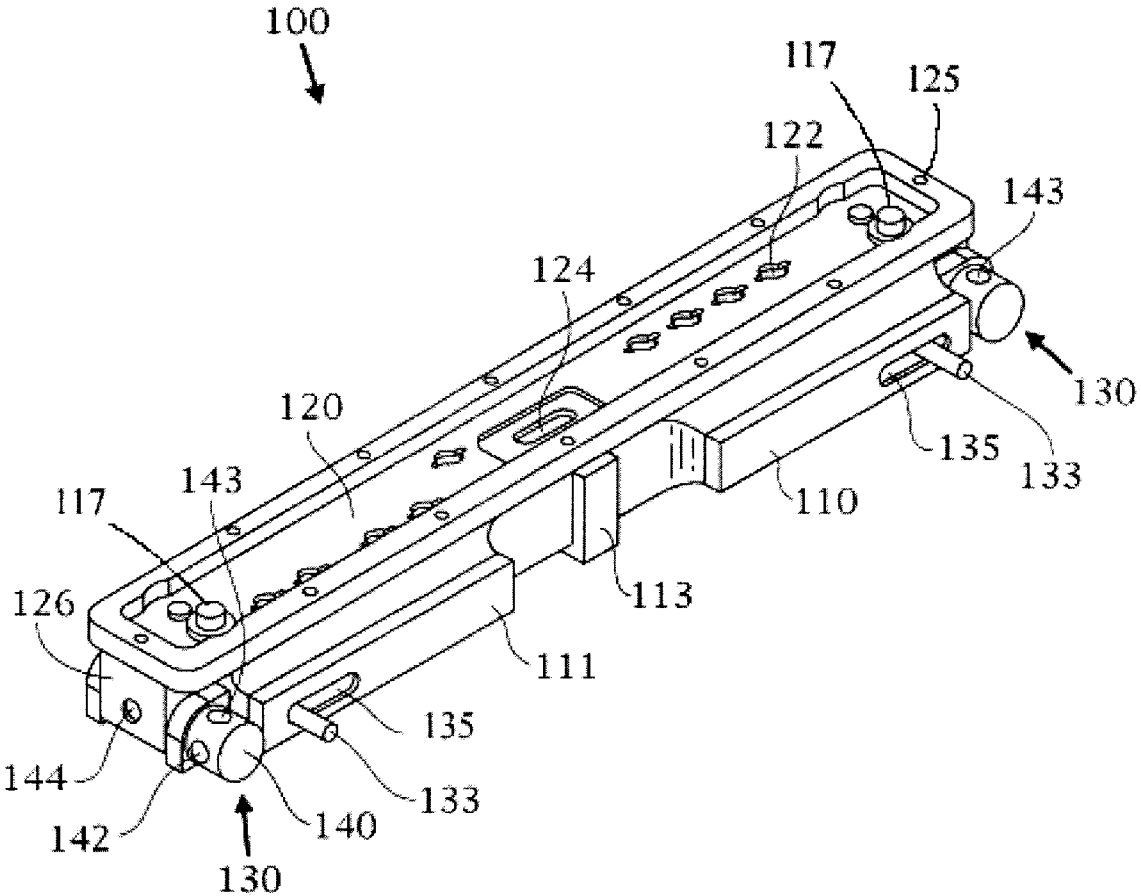
FIG. 5 is a bottom perspective view of the connector assembly 100 of FIG. 3 showing the device guides 110, 111 in the closed position.

FIG. 3 is a top perspective view of a connector assembly 100 according to a first embodiment of the present invention showing articulating card guides 110, 111 in an open position. FIGS. 4 and 5 are, respectively, top and bottom perspective views of the connector assembly 100 of FIG. 3 showing the device guides 110, 111 in the closed position.

The connector assembly 100 of the present invention generally comprises a pair of rigid, foldable card guides 110, 111 pivotally attached to a rigid connector base plate 120. The card guides 110, 111 may be pivoted to the open position shown in FIG. 3 to receive an electronic device therein such as, for example, a circuit card. When an electronic device is not present, the card guides 110, 111 may be pivoted to the closed, space saving position shown in FIG. 4 for safety, storage, and/or shipping purposes. The guides 110, 111 are maintained in either the open or closed position via the engagement of a spring-loaded bullet pin assembly 130 with one of two intersecting, diametrically-oriented holes 142 drilled through an end of the radial locating pin 140.

The connector base plate 120 is preferably a section of rigid, commercially available material (e.g. a plastic such as glass-filled polyester, or Delrin™ polyoxymethylene, chosen for its strength over temperature, its machineability, and its relatively low cost.). Base plate 120 possesses a plurality of round and/or rectangular pin receptacles 122, 124, respectively, and a tab 126 at both ends for pivotal attachment of the card guides 110, 111 via a locating pin 140 inserted therethrough. The pin receptacles 122, 124 are openings through the base plate 120 positioned such that they match the positions of the contact pins resident on the device to which the present invention is attached. The connector base plate 120 may be fixedly attached to the underlying testing unit by screws (not shown in the Figures) that protrude through a plurality of mounting holes 125. The base plate 120 possesses a plurality of bullet pins 116 and clinch nuts 117 for aligning and securing the UUT prior to testing.

The card guides 110, 111 are also preferably fabricated of rigid, non-conductive, commercially available materials (e.g. again, Delrin®) plastic or the like). Each guide 110, 111 includes a lengthwise channel 112 for receiving an edge of a circuit card or other card-shaped electronic device. The card guides 110, 111 extend to two opposing tabs 114 at one end which yoke tabs 126 on the base plate 120 and allow them to be pivotally attached thereto via the locating pins 140. In addition, a spring-loaded bullet pin assembly 130 is loaded into each card guide 110, 111 for locking engagement with locating pin 140, thereby selectively locking the card guides 110, 111 in position. One of the card guides 110 also includes a sealing lip 113 at its distal end designed to overlap, as best seen in FIG. 4, the distal end of the other card guide 111 when the two guides 110, 111 are pivoted to the closed position. The overlap creates an environmental seal for the pin receptacles 122, 124 located within the closed guides 110, 111.

The distal end of the locating pin 140 projects through the tabs 114, 126 to establish a pivoting connection between the card guides 110, 111 and the connector base plate 120. A set screw 144, positioned in the connector base plate's tab 126, prevents relative rotation between the pin 140 and the connector base plate 120. The pin 140 and the set screw 144 may be fabricated of commercially available materials such as stainless steel or the like. The radial head of the locating pin 140 includes two perpendicular through holes 142, 143 that intersect at an angle of 90° at the central axis of the pin 140. The pin 140 is positioned in the connector assembly 100 such that central axis of hole 142 lies parallel to the plane of the connector base plate 120, while the central axis of hole 143 lies perpendicular to that same plane. Spring-loaded bullet pin assembly 130 selectively engages the holes 142, 143: when inserted in hole 142 holds the card guides 110, 111 in the closed position, while when inserted in hole 143 maintains the card guides 110, 111 in the open position.

Figure 6:
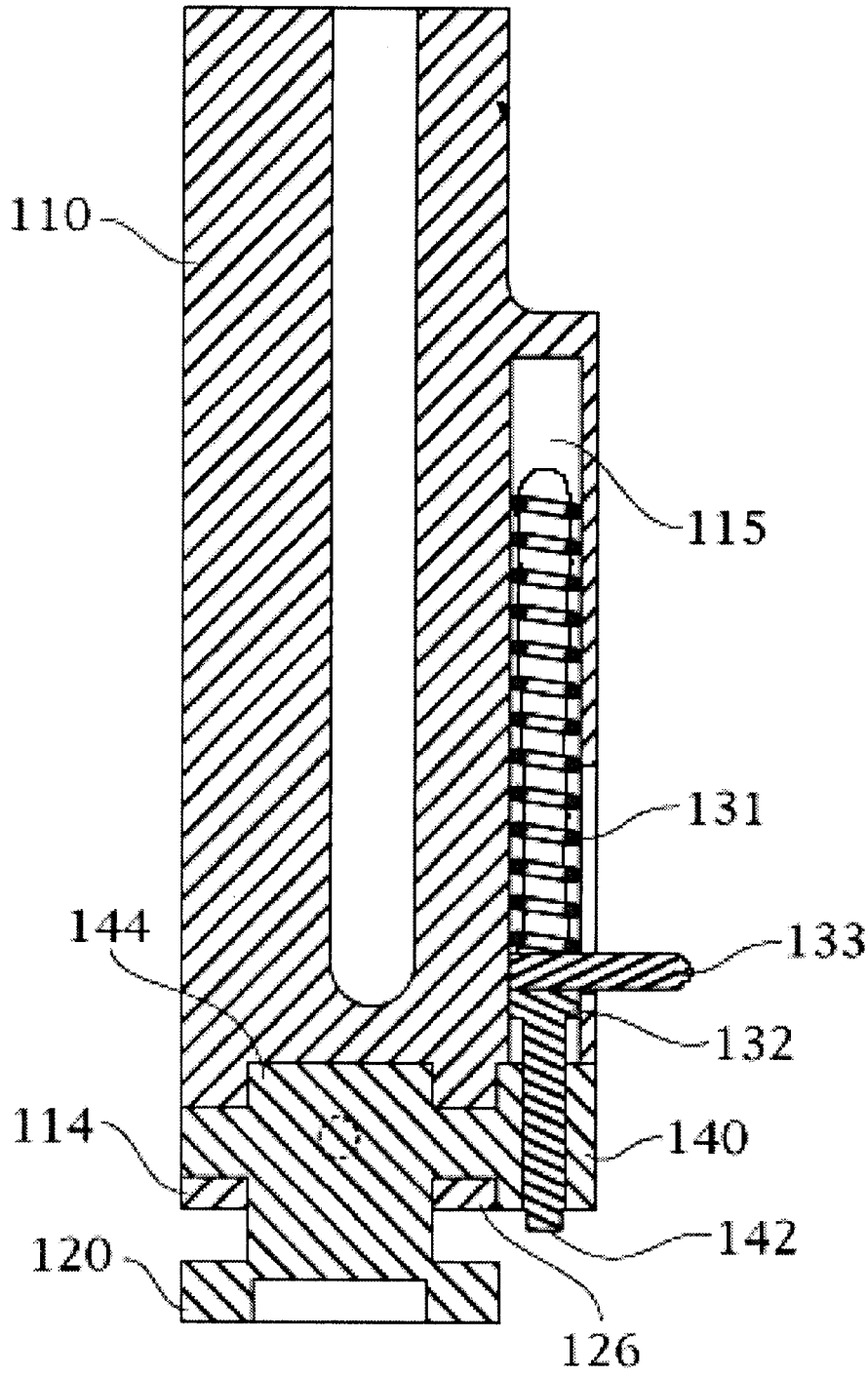
FIG. 6 is a close up, partially cut-away perspective view showing the interaction between the spring-loaded bullet pin assemblies 130 and the radial locating pins 140.

With reference to FIG. 6, the spring-loaded bullet pin assemblies 130 are slidably enclosed within cavities 115 located in the card guides 110, 111. Each assembly 130 includes a spring 131 mounted on internal detent pin 132, and an external release pin 133. Each of the components of the bullet pin assemblies 130 may be fabricated of commercially available materials such as stainless steel, plastic, etc. The internal pin 132 is fixedly attached at a 90° angle to the external pin 133. The external pin 133 extends out of the cavity 115 through an open slot 135. The spring 131, which is carried on internal pin 132, exerts a force on the internal pin 132/external pin 133 combination along the axis of the internal pin 132 in the direction of the radial locating pin 140. The spring force holds the distal end of the internal pin 132 in one of the perpendicular-oriented holes 142, 143 located in the head of the locating pin 140. The slot 135 serves to limit the amount of travel that may be experienced by the bullet pin assembly 130, and it provides finger-access to external pin 132.

With reference to FIGS. 3–6, the following sequence of steps is required to pivot the card guides 110, 111 from the open position of FIG. 3 to the closed position of FIGS. 4 and 5. Guide 111 is closed first. This is accomplished by exerting force, in excess of that provided by the spring 131, on the external pin 133 in the direction of arrow 138. The resulting movement of the external pin 133 causes the distal end of the internal pin 132 to be disengaged from the diametrically-oriented hole 143. Pushing on the distal end of the guide 111 causes it to pivot about the pin 140 until the internal pin 132 is brought into alignment with the other diametrically-oriented hole 142. Removal of the force on the external pin 133 in the direction of arrow 138 allows the internal pin to engage with the hole 142 and hold the guide 111 in the closed position. The above steps are then repeated to close guide 110. This causes the sealing lip 113 located at the distal end of guide 110 to cover the distal end of guide 111 and create an environmental seal over the pin receptacles 122, 124 positioned therein.

To return the card guides 110, 111 to the open position of FIG. 3, the above sequence of steps is reversed.

The card guides 110, 111 fold down to save space and to completely cover the pin receptacles 122, 124 (i.e. via the overlapping seal between the two card guides), as well as the corresponding electrical connectors resident on the underlying electronic device to which the connector assembly 100 is attached. This affords full protection from the surrounding environment (i.e. prevent the collection of dirt and/or particulate matter). The foldable design also decreases the chance of inadvertent injury to personnel and, when the guides 110, 111 are locked firmly in the closed position, secures the card guides for storage and/or shipment. When the card guides 110, 111 are locked in the open position, they direct an electronic device subject to testing (e.g. RF converter) into and out of the underlying electronic device. The connector assembly 100 of the present invention improves testing efficiency, is very durable (i.e. not easily damaged during the loading or unloading of an electronic device), and is designed and constructed in a manner that is economical to manufacture and sell.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

I claim:

1. A connector assembly, comprising:

a connector base plate including an array of electrical connections;

a first guide arm pivotally attached to said connector base plate housing at one end, said first guide arm comprising a distal sealing lip and a lengthwise channel for slidable insertion of an electronic device; and a second guide arm pivotally attached to said connector housing at another end, said second guide arm comprising a lengthwise channel for slidable insertion of said electronic device, and said second guide arm having a distal end conforming to the sealing lip of said first guide arm for engaging said sealing lip when said first and second guide arms are pivoted together;

wherein said first and second guide arms fully cover said connector housing when pivoted together.

2. The connector assembly according to claim 1, wherein said first and said second guide arms fuirther comprise a detent pin assembly for being locked in either a first position or a second position.

3. The connector assembly according to claim 2, wherein said first guide arm and second guide arm are pivotally attached to said connector base plate by pivot pins having a radial hub with at least one axial hole therein, and said detent pin assembly further comprises a spring carried on a detent pin, said detent pin being oriented to selectively engage the hole(s) in the hub of the pivot pins.

4. The connector assembly according to claim 3, wherein said at least one hole comprises two perpendicular holes.

5. The connector assembly according to claim 2, wherein said first and said second guide arms are independently lockable in a first position with said lengthwise channels aligned directly opposite one another, thereby facilitating the insertion of said edges of said electronic device.

6. The connector assembly according to claim 2, wherein said first and said second guide arms are independently lockable in a second position with said sealing lip of said first guide arm engaging said end of said second guide arm, thereby creating an environmental and safety seal over said array of holes in said plate and said corresponding array of connectors on said electronic device.

7. A connector assembly, comprising:

a connector base plate including an array of electrical connections;

a first guide arm pivotally attached to said connector base plate housing at one end by a first pivot pin having a radial hub with at least one axial bore hole, a second guide arm pivotally attached to said connector housing at another end by a second pivot pin having a radial hub with at least one axial bore hole, said first and said second guide arms both including a detent pin assembly for selectively engaging the bore hole in the hub of the pivot pins, thereby locking said first and said second guide arms in position.

8. The connector assembly according to claim 7, wherein said first and second pivot pins both have radial hubs with two axial and perpendicular bore holes.

9. The connector assembly according to claim 8, wherein said first and said second guide arms are independently lockable in a first position with said lengthwise channels aligned directly opposite one another.

10. The connector assembly according to claim 7, wherein said first guide arm further comprises a distal sealing lip and a lengthwise channel for slidable insertion of an electronic device; and said second guide arm further comprises a distal end conforming to the sealing lip of said first guide arm for engaging said sealing lip when said first and second guide arms are pivoted together.

11. The connector assembly according to claim 10, wherein said first and second guide arms fully cover said connector housing when pivoted together.

12. The connector assembly according to claim 10, wherein said first and second guide arms are independently lockable in a second position with said sealing lip of said first guide arm engaging said end of said second guide arm, thereby creating an environmental and safety seal over said array of holes in said plate and said corresponding array of connectors on said electronic device.

* * * * *